US009696685B2

(12) United States Patent
Okabe

(10) Patent No.: US 9,696,685 B2
(45) Date of Patent: Jul. 4, 2017

(54) IMAGE FORMING APPARATUS HAVING CARTRIDGES

(71) Applicant: Brother Kogyo Kabushiki Kaisha, Nagoya-shi, Aichi-ken (JP)

(72) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/076,838

(22) Filed: Mar. 22, 2016

(65) Prior Publication Data

US 2016/0202656 A1 Jul. 14, 2016

Related U.S. Application Data

(63) Continuation of application No. 14/192,980, filed on Feb. 28, 2014, now Pat. No. 9,323,215.

(30) Foreign Application Priority Data

Feb. 28, 2013 (JP) ..... 2013-039770

(51) Int. Cl.
*G03G 21/18* (2006.01)
*G03G 15/00* (2006.01)

(52) U.S. Cl.
CPC ..... *G03G 21/1864* (2013.01); *G03G 15/80* (2013.01); *G03G 21/1871* (2013.01); *G03G 2215/0141* (2013.01)

(58) Field of Classification Search
CPC combination set(s) only.
See application file for complete search history.

(56) References Cited

U.S. PATENT DOCUMENTS 8,068,763 B2 11/2011 Hashimoto
8,577,255 B2 11/2013 Okabe
(Continued)

FOREIGN PATENT DOCUMENTS

JP 2008-165025 A 7/2008
JP 2010-008723 A 1/2010
(Continued)

OTHER PUBLICATIONS

Product Information of Samsung CLX6260FW Printer.
Sep. 13, 2016—(JP) Office Action—App 2013-039770.

*Primary Examiner* — Clayton E Laballe
*Assistant Examiner* — Jas Sanghera
(74) *Attorney, Agent, or Firm* — Banner & Witcoff, Ltd.

(57) ABSTRACT

An image forming apparatus includes: a main body; a first cartridge; a second cartridge; and a retaining member. The main body includes a first power-supplying part; and a second power-supplying part. The first cartridge includes a first power-receiving part. The second cartridge includes a second power-receiving part. The first and second power-receiving parts are configured to contact with the first and second power-supplying parts respectively. The retaining member is configured to retain the first and second cartridges and includes one side wall having a frame formed of a resin material and a reinforcing member formed of a metal material. A top edge of the frame is positioned lower than top edges of the first and second power-receiving parts. A top edge of the reinforcing member is positioned at a same vertical position as or lower than the top edge of the frame.

18 Claims, 9 Drawing Sheets

(56) References Cited

U.S. PATENT DOCUMENTS

| | | | | |
|---|---|---|---|---|
| 8,583,006 | B2 | 11/2013 | Murayama et al. | |
| 9,323,215 | B2 * | 4/2016 | Okabe | G03G 21/1864 |
| 2008/0159773 | A1 | 7/2008 | Murayama et al. | |
| 2009/0041498 | A1 | 2/2009 | Numagami et al. | |
| 2009/0324280 | A1 | 12/2009 | Hashimoto | |
| 2010/0028043 | A1 | 2/2010 | Hashimoto et al. | |
| 2010/0111562 | A1 | 5/2010 | Okabe et al. | |
| 2012/0070191 | A1 | 3/2012 | Im et al. | |
| 2012/0128387 | A1 | 5/2012 | Kim et al. | |
| 2012/0177403 | A1 | 7/2012 | Murayama et al. | |
| 2013/0022367 | A1 | 1/2013 | Choi et al. | |
| 2013/0108316 | A1 | 5/2013 | Sato et al. | |
| 2013/0156463 | A1 | 6/2013 | Jung et al. | |

FOREIGN PATENT DOCUMENTS

| | | | |
|---|---|---|---|
| JP | 2010-107890 | A | 5/2010 |
| JP | 2011112705 | A | 6/2011 |
| JP | 2012-212188 | A | 11/2012 |

* cited by examiner

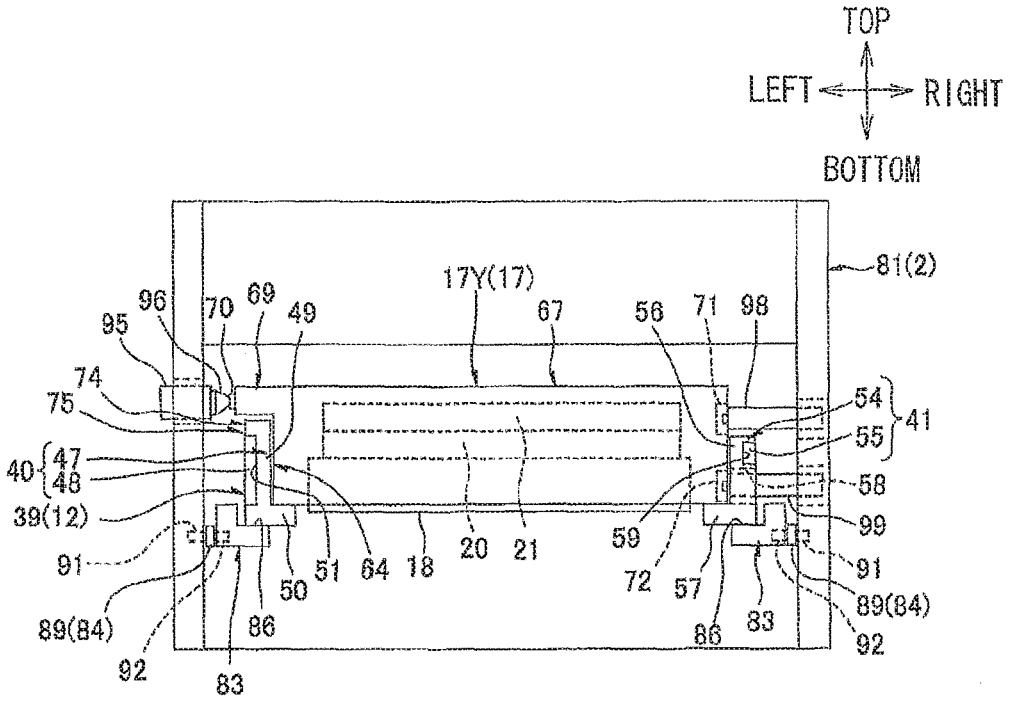
TOP
LEFT
RIGHT
BOTTOM
81(2)
17Y(17)
67
56
71
98
96
70
69
49
95
74
75
54
55
41
40
47
48
39(12)
58
99
91
89(84)
92
83
86
50
51
64
18
20
21
59
72
57
86
83
91
89(84)
92

IMAGE FORMING APPARATUS HAVING CARTRIDGES

CROSS REFERENCE TO RELATED APPLICATION

This application is a continuation of U.S. patent application Ser. No. 14/192,980 filed Feb. 28, 2014, which claims priority from Japanese Patent Application No. 2013-039770 filed Feb. 28, 2013. The entire contents of the priority applications are incorporated herein by reference.

TECHNICAL FIELD

The present invention relates to an image forming apparatus employing an electro-photographic system.

BACKGROUND

One image forming apparatus known in the art is a tandem-type color printer having a plurality of cartridges that are detachably disposed in the main body.

One such color printer that has been proposed has a cartridge tray for supporting the plurality of cartridges. The cartridge tray is retained in the main body and can slide into and out of the main body (see Japanese Patent Application Publication No. 2008-165025).

SUMMARY

In view of the foregoing, it is an object of the present invention to provide a novel image forming apparatus.

In order to attain the above and other objects, the present invention provides an image forming apparatus that includes a main body; a first cartridge; a second cartridge; and a retaining member. The main body includes a first power-supplying part; and a second power-supplying part. The first cartridge includes a first process body; and a first power-receiving part. The first process body is used for forming an image, and extends in a first direction generally perpendicular to a vertical direction. The first power-receiving part is provided in one side of the first cartridge in the first direction, and configured to contact with the first power-supplying part and supply power from the first power-supplying part to the first process body. The second cartridge includes a second process body; and a second power-receiving part. The second process body is used for forming an image, and extends in the first direction. The second power-receiving part is provided in one side of the second cartridge in the first direction, and configured to contact with the second power-supplying part and supply power from the second power-supplying part to the second process body. The retaining member is configured to retain the first cartridge and the second cartridge and be movable between a first position inside the main body and a second position outside the main body. The first cartridge and the second cartridge are arranged in parallel to one another in a second direction generally perpendicular to both the first direction and the vertical direction. The retaining member includes one side wall provided in one side of the retaining member in the first direction. The one side wall has a first frame formed of a metal material. A top edge of the first frame in the vertical direction is positioned lower than a top edge of the first power-receiving part and a top edge of the second power-receiving part. A top edge of the first reinforcing member in the vertical direction is positioned at a same vertical position as or lower than the top edge of the first frame.

According to another aspect, the present invention provides an image forming apparatus that includes a main body; a first cartridge; a second cartridge; and a retaining member. The main body includes a first drive-supplying part; and a second drive-supplying part. The first cartridge includes a first process body; and a first drive-transmitting part. The first process body is used for forming an image, and extends in a first direction generally perpendicular to a vertical direction. The first drive-transmitting part is provided in one side of the first cartridge in the first direction, and configured to contact with the first drive-supplying part and transmit a drive force from the first drive-supplying part to the first process body. The second cartridge includes a second process body; and a second drive-transmitting part. The second process body is used for forming an image, and extends in the first direction. The second drive-transmitting part is provided in one side of the second cartridge in the first direction, and configured to contact with the second drive-supplying part and transmit a drive force from the second drive-supplying part to the second process body. The retaining member is configured to retain the first cartridge and the second cartridge and be movable between a first position inside the main body and a second position outside the main body. The first cartridge and the second cartridge are arranged in parallel to one another in a second direction generally perpendicular to both the first direction and the vertical direction. The retaining member includes one side wall provided in one side of the retaining member in the first direction. The one side wall has a frame formed of a resin material and a reinforcing member formed of a metal material. A top edge of the frame in the vertical direction is positioned at a same vertical position as or lower than a bottom edge of the first drive-transmitting part and a bottom edge of the second drive-transmitting part. A top edge of the reinforcing member in the vertical direction is positioned at a same vertical position as or lower than a top edge of the frame.

According to another aspect, the present invention provides an image forming apparatus that includes a main body; a first cartridge; and a retaining member. The main body includes a first power-supplying part. The first cartridge includes a first developing roller; and a first electrode. The first developing roller extends in a first direction. The first electrode is provided in one side of the first cartridge in the first direction, and configured to directly contact with the first power-supplying part and supply power from the first power-supplying part to the first developing roller. The retaining member is configured to retain the first cartridge and be movable between a first position inside the main body and a second position outside the main body. The retaining member includes one side wall provided in one side of the retaining member in the first direction. The one side wall has a first frame formed of a resin material and a first reinforcing plate formed of a metal material. A top edge of the first reinforcing plate in a vertical direction is positioned at a same vertical position as or lower than a top edge of the first frame.

BRIEF DESCRIPTION OF THE DRAWINGS

The particular features and advantages of the invention as well as other objects will become apparent from the following description taken in connection with the accompanying drawings, in which:

FIG. 2A is a view explaining how a drawer frame is detached from a main casing of the printer according to the first embodiment, wherein the drawer frame is in a mounted position;

FIG. 2B is a cross-sectional view of the printer according to the first embodiment taken along a plane IIB-IIB shown in FIG. 2A;

DETAILED DESCRIPTION

1. Overall Structure of a Printer

Figure 1:
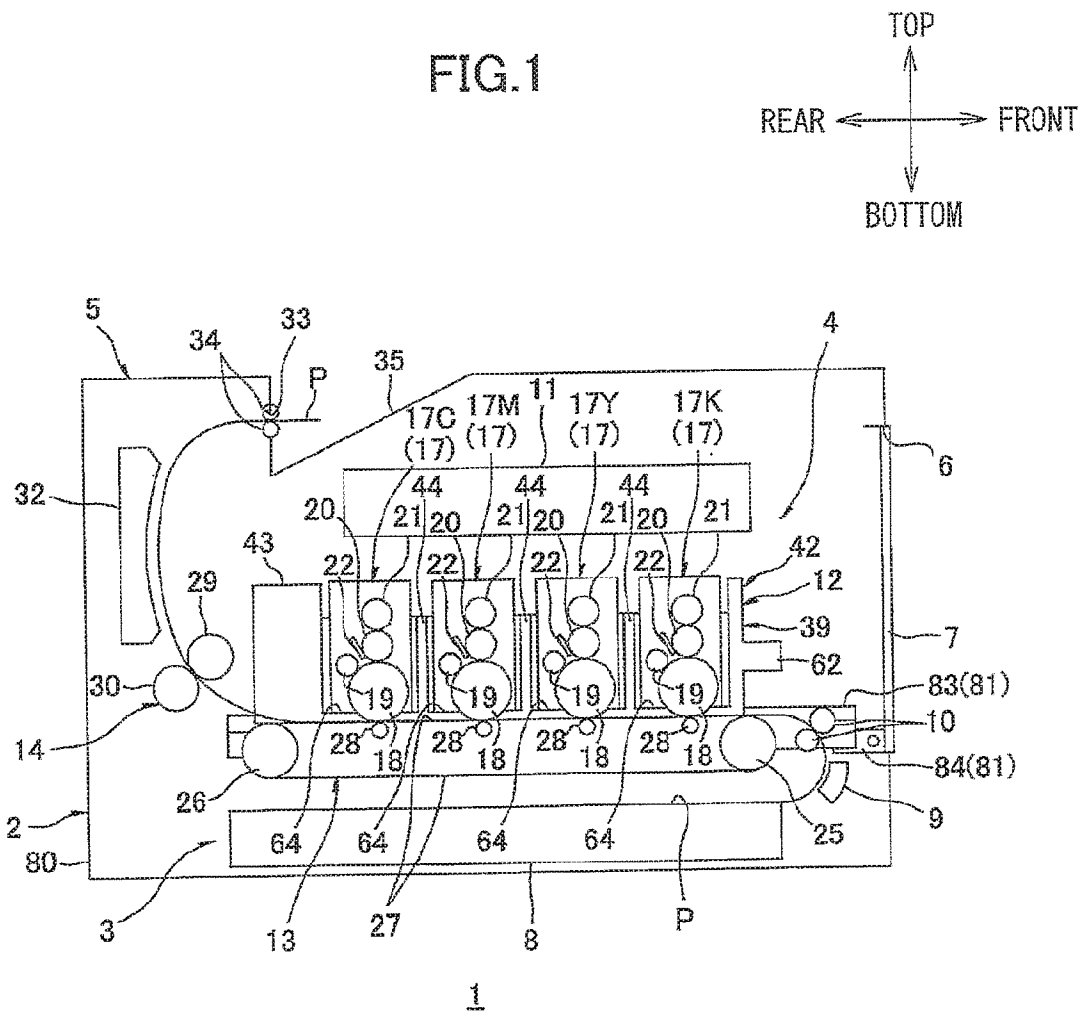
FIG. 1 is a schematic central cross-sectional view illustrating a general configuration of a printer according to a first embodiment of the present invention.

A printer 1 shown in FIG. 1 is a horizontal direct tandem-type color laser printer. The printer 1 includes a main casing 2 and, within the main casing 2, a sheet-feeding unit 3 for feeding sheets of a paper P, an image-forming unit 4 for forming images on the sheets of paper P fed by the sheet-feeding unit 3, and a sheet-discharging unit 5 for discharging the sheets of paper P after an image has been formed thereon.

Directions in the following description related to the printer 1 will assume that the printer 1 is placed right side up on a level surface. Hence, the upper side of the printer 1 in FIG. 1 will be called the "top," and the lower side will be called the "bottom." Further, the right side of the printer 1 in FIG. 1 will be called the "front," and the left side will be called the "rear." Left and right sides of the printer 1 will be based on the perspective of a user facing the front of the printer 1. Therefore, the near side of the printer 1 in FIG. 1 will be called the "left side," and the far side will be called the "right side."

(1) Main Casing

The main casing 2 is box-shaped and substantially rectangular in a side view. The main casing 2 accommodates the sheet-feeding unit 3 and image-forming unit 4. The main casing 2 includes a front wall in which is formed an access opening 6, and a front cover 7 that is pivotably provided over the access opening 6. The front cover 7 can pivot about its lower edge between a closed position shown in FIG. 2A for covering the access opening 6, and an open position shown in FIG. 4A for exposing the access opening 6.

(2) Sheet-Feeding Unit

As shown in FIG. 1, the sheet-feeding unit 3 includes a paper tray 8 that accommodates sheets of the paper P. The paper tray 8 is detachably mounted in the bottom section of the main casing 2. The paper tray 8 has a feeding guide 9, and a pair of registration rollers 10.

The sheets of paper P accommodated in the paper tray 8 are separated and guided one sheet at a time along a U-shaped path. Each sheet begins in a forward direction, is guided upward by the feeding guide 9 to a position between the registration rollers 10, and is supplied rearward by the registration rollers 10. The registration rollers 10 convey each sheet at a prescribed timing toward transfer positions between photosensitive drums 18 and a conveying belt 27 (both described later) in the image-forming unit 4.

(3) Image-Forming Unit

The image-forming unit 4 includes a scanning unit 11, a drawer unit 12, a transfer unit 13, and a fixing unit 14.

(3-1) Scanning Unit

The scanning unit 11 is provided in the top section of the main casing 2. The scanning unit 11 irradiates laser beams based on image data toward four photosensitive drums 18 described later, thereby exposing the photosensitive drums 18.

(3-2) Drawer Unit

The drawer unit 12 is disposed beneath the scanning unit 11 in the approximate vertical center of the main casing 2. The drawer unit 12 retains four process cartridges 17 corresponding one-on-one to the four printing colors.

The process cartridges 17 are arranged parallel to one another and are spaced at intervals in the front-rear direction. The four process cartridges 17 include a black process cartridge 17K, a yellow process cartridge 17Y, a magenta process cartridge 17M, and a cyan process cartridge 17C arranged from the front of the drawer unit 12 to the rear in the order given.

Each of the process cartridges 17 includes a photosensitive drum 18, a charging roller 19, a developing roller 20, a supply roller 21, and a thickness-regulating blade 22.

The photosensitive drum 18 has a general cylindrical shape that is elongated in the left-right direction. The photosensitive drum 18 is rotatably supported in the lower end of the corresponding process cartridge 17 so as to be exposed through the bottom thereof.

Each charging roller 19 has a general columnar shape that is elongated in the left-right direction. The charging roller 19 contacts the corresponding photosensitive drum 18 from the upper rear side thereof.

Each developing roller 20 has a general columnar shape that is elongated in the left-right direction. The developing roller 20 contacts the corresponding photosensitive drum 18 from above.

Each supply roller 21 has a general columnar shape that is elongated in the left-right direction. The supply roller 21 contacts the corresponding developing roller 20 from above.

Each thickness-regulating blade 22 contacts the corresponding developing roller 20 from the rear side.

Each of the process cartridges 17 has a space formed in its upper section for accommodating toner of the corresponding color.

Toner accommodated in each process cartridge 17 is supplied to the corresponding supply roller 21, and the supply roller 21 in turn supplies the toner onto the corresponding developing roller 20. The toner is positively tribocharged between the supply roller 21 and developing roller 20.

The thickness-regulating blade 22 regulates the thickness of toner supplied to the developing roller 20 as the developing roller 20 rotates, maintaining the toner carried on the surface of the developing roller 20 at a thin uniform thickness.

In the meantime, the charging roller 19 applies a uniform charge to the surface of the corresponding photosensitive drum 18, as the photosensitive drum 18 rotates. Subsequently, the scanning unit 11 scans a laser beam at a high speed over the surface of the photosensitive drum 18 to form an electrostatic latent image on the surface of the photosensitive drum 18 corresponding to an image to be formed on the paper P.

As the photosensitive drum 18 continues to rotate, the positively charged toner carried on the surface of the developing roller 20 is supplied to the latent image formed on the surface of the photosensitive drum 18. The toner supplied by the developing roller 20 produces a toner image on the surface of the photosensitive drum 18 through reversal development.

(3-3) Transfer Unit

The transfer unit 13 is disposed in the main casing 2 at a position above the sheet-feeding unit 3 and beneath the drawer unit 12. The transfer unit 12 is oriented to extend in the front-rear direction. The transfer unit 13 includes a drive roller 25 and a follow roller 26 that are arranged parallel to each other and separated in the front-rear direction, a conveying belt 27 looped around the drive roller 25 and follow roller 26, and four transfer rollers 28 positioned to confront corresponding photosensitive drums 18 with the upper portion of the conveying belt 27 interposed therebetween.

When a sheet of paper P is supplied from the sheet-feeding unit 3 onto the upper portion of the conveying belt 27, the conveying belt 27 conveys the sheet rearward so as to pass sequentially through each transfer position between the corresponding pairs of photosensitive drums 18 and transfer rollers 28. At this time, the toner images of the four colors carried on the four photosensitive drums 18 are sequentially transferred onto the sheet of paper P as the sheet is conveyed through the transfer positions.

(3-4) Fixing Unit

The fixing unit 14 is disposed to the rear of the transfer unit 13. The fixing unit 14 includes a heating roller 29, and a pressure roller 30 confronting the lower rear side of the heating roller 29. After a color image has been transferred onto a sheet of paper P in the transfer unit 13, the sheet is conveyed to the fixing unit 14. As the sheet passed between the heating roller 29 and pressure roller 30, the color image is fixed to the paper P by heat and pressure.

(4) Sheet-Discharging Unit

The sheet-discharging unit 5 is formed in the upper portion of the main casing 2 and has a general V-shape in a side view that is open on the top. The sheet-discharging unit 5 includes a discharge guide 32, a discharge opening 33, a pair of discharge rollers 34, and a discharge tray 35.

After a toner image has been fixed to a sheet of paper P in the fixing unit 14, the sheet is guided along a general U-shaped path processing upward along the discharge guide 32 and then forward toward the pair of discharge rollers 34. The sheet passes through the discharge rollers 34 and is discharged from the discharge opening 33 onto the discharge tray 35.

2. Drawer Unit

The drawer unit 12 is provided with a drawer frame 39, and the four process cartridges 17 described above.

(1) Drawer Frame

Figure 4A:
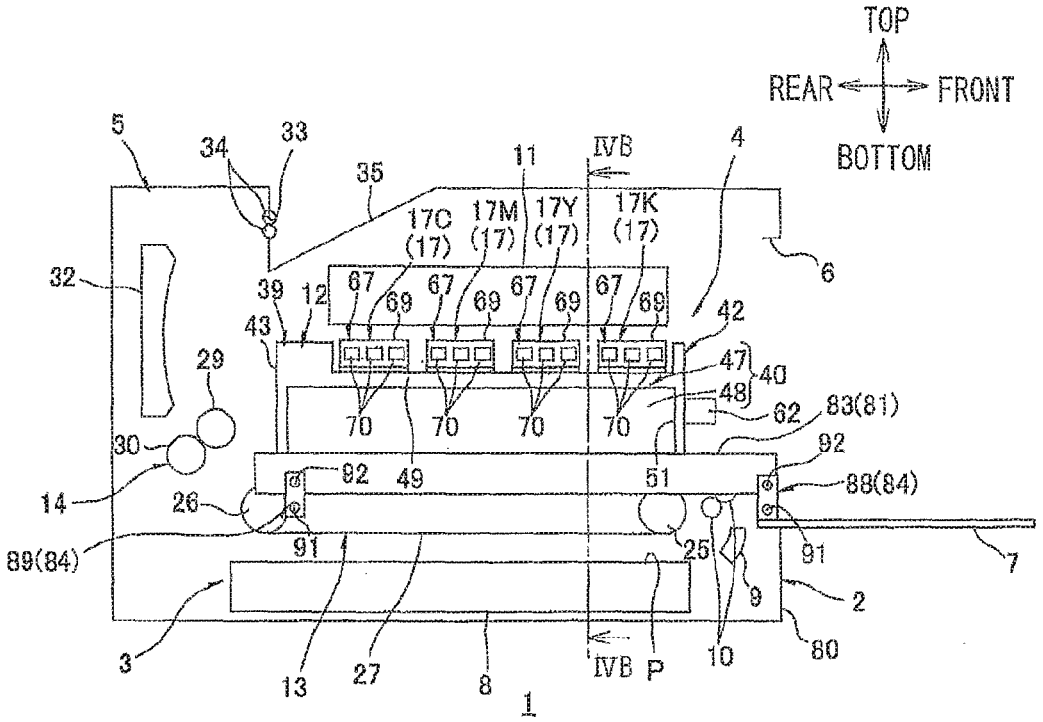
FIG. 4A is a view explaining how the drawer frame is detached from the main casing of the printer according to the first embodiment, wherein the drawer frame is in an intermediate position.
Figure 4B:
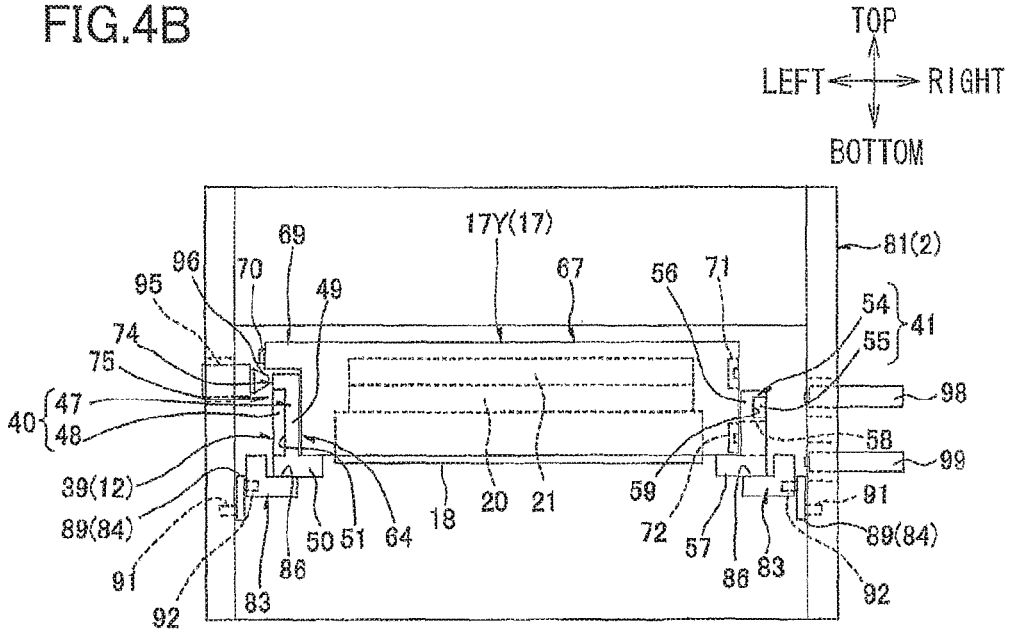
FIG. 4B is a cross-sectional view of the printer according to the first embodiment taken along a plane IVB-IVB shown in FIG. 4A.

When positioned inside the main casing 2, the drawer frame 39 is configured to pivot between a mounted position shown in FIGS. 2A and 2B, and an intermediate position shown in FIGS. 4A and 4B. When the drawer frame 39 is in the mounted position, cartridge-side electrodes 70 are connected to body-side electrodes 95, development couplings 71 are connected to development drive supply units 98, and drum couplings 72 are connected to drum drive supply units 99. All of the above components will be described later. When the drawer frame 39 is in the intermediate position, the above components are disconnected from each other.

The drawer frame 39 is also configured to be able to slide along the front-rear direction between the intermediate position described above and an external position shown in FIGS. 5 and 6 by pulling the drawer frame 39 out from the main casing 2. As shown in FIGS. 2A and 2B, the drawer frame 39 has a generally square cylindrical shape that is open on its top and bottom. As shown in FIGS. 1 and 7A, the drawer frame 39 includes a left wall 40, a right wall 41, a front wall 42, a rear wall 43, and three partitioning walls 44.

As shown in FIG. 2B, the left wall 40 and right wall 41 are arranged parallel to each other and are separated in the left-right direction.

The left wall 40 includes a left frame 47, and a left reinforcing member 48.

The left frame 47 is formed of a resin material, such as acrylonitrile butadiene styrene (ABS) or polystyrene (PS). In a left side view, the top edge of the left frame 47 is positioned lower than the top and bottom edges of cartridge-side electrodes 70 provided on cartridge frames 67 described later. The left frame 47 includes a left plate part 49, and a left support part 50.

The left plate part 49 has a flat plate shape that is substantially rectangular in a side view and is elongated in the front-rear direction. The left plate part 49 also includes a left-reinforcing-member mounting part 51.

The left-reinforcing-member mounting part 51 is a generally rectangular recessed part formed in the left surface of the left plate part 49 in an area excluding the peripheral edges.

The left support part 50 is a ridge-like member protruding rightward from the bottom edge of the left plate part 49.

The left reinforcing member 48 is formed of a metal material, such as a galvanized steel sheet (SECC) or a stainless steel sheet (SUS) in a flat plate shape that is generally rectangular in a side view and elongated in the front-rear direction. The left reinforcing member 48 is formed with outer dimensions that can be received in the left-reinforcing-member mounting part 51 formed in the left plate part 49. Thus, the top edge of the left reinforcing member 48 is positioned lower than the top edge of the left frame 47 in a left side view.

The right wall 41 includes a right frame 54, and a right reinforcing member 55.

The right frame 54 is formed of a resin material, such as ABS or PS. In a right side view, the top edge of the right frame 54 is positioned lower than the top edges of development couplings 71 described later. The right frame 54 has a front-rear dimension equivalent to that of the left frame 47. The right frame 54 further includes a right plate part 56, and a right support part 57.

Figure 6:
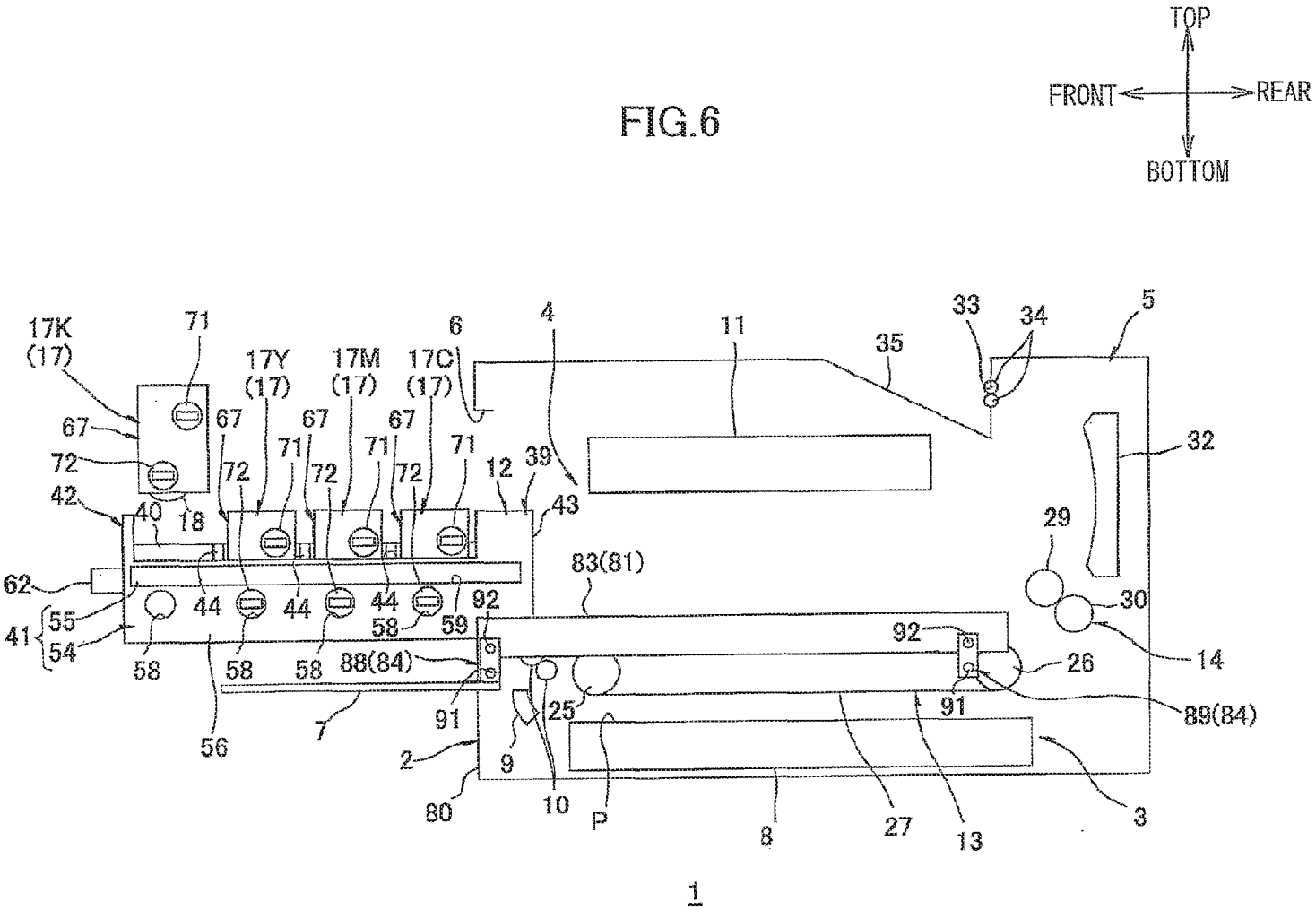
FIG. 6 is a right side view explaining how the drawer frame is detached from the main casing of the printer according to the first embodiment, wherein the drawer frame is in the external position.
Figure 7A:
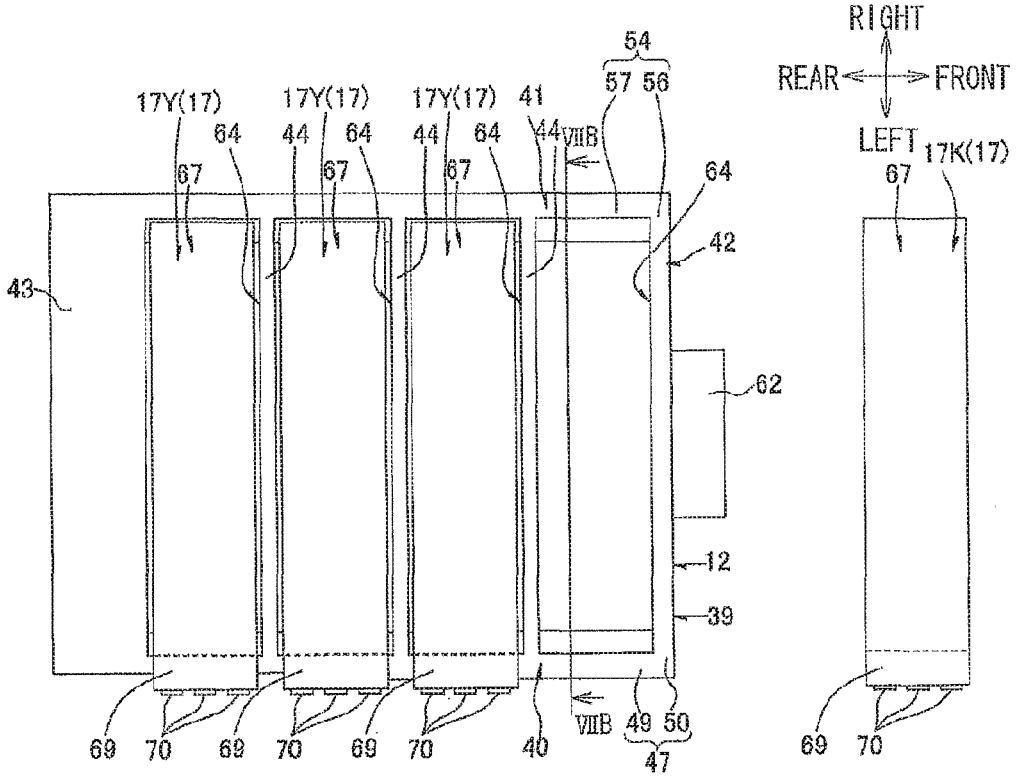
FIG. 7A is a planar view showing the drawer frame of the printer according to the first embodiment, wherein a black process cartridge is detached from the drawer frame.
Figure 7B:
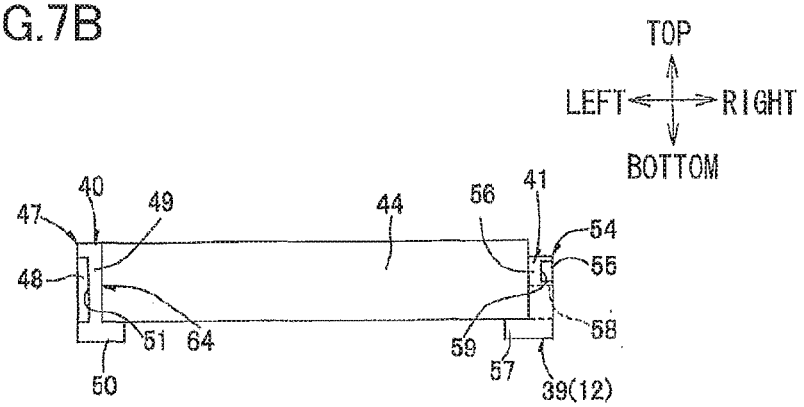
FIG. 7B is a cross-sectional view of the drawer frame of the printer according to the first embodiment taken along a plane VIIB-VIIB shown in FIG. 7A.

As shown in FIGS. 2B and 6, the right plate part 56 has a flat plate shape that is substantially rectangular in a side view and elongated in the front-rear direction. The right plate part 56 includes four drive input holes 58, and a right-reinforcing-member mounting part 59.

The drive input holes 58 are spaced at intervals in the front-rear direction and are positioned to correspond to drum drive supply units 99 (described later) of the process cartridges 17. The drive input holes 58 are circular in a side view and penetrate the right plate part 56.

The right-reinforcing member mounting part 59 is a generally rectangular depression formed in the right surface of the right plate part 56. The right-reinforcing-member mounting part 59 is formed in a portion of the right plate part 56 above the drive input holes 58 and excluding the peripheral edges.

The right support part 57 is a ridge-like member that protrudes leftward from the bottom edge of the right plate part 56.

The right reinforcing member 55 is formed of a metal material, such as a galvanized steel sheet (SECC) or a stainless steel sheet (SUS) in a flat plate shape that is generally rectangular in a side view and elongated in the front-rear direction. The front-rear dimension of the right reinforcing member 55 is equivalent to that of the left reinforcing member 48. The outer dimensions of the right reinforcing member 55 are set such that the right reinforcing member 55 can be received in the right-reinforcing-member mounting part 59 of the right plate part 56. Hence, in a right side view, the upper edge of the right reinforcing member 55 is positioned below the upper edge of the right frame 54.

As shown in FIG. 2A, the front wall 42 has a generally flat plate shape that is elongated in the left-right direction and spans between the front edges of the left wall 40 and right wall 41. A grip part 62 is provided on the front surface of the front wall 42 for the user to grip.

The rear wall 43 has a generally flat plate shape that is elongated in the left-right direction and spans between the rear edges of the left wall 40 and right wall 41.

As shown in FIGS. 1 and 7A, three of the partitioning walls 44 are arranged at intervals in the front-rear direction so as to partition the space between the front wall 42 and rear wall 43 into four equal areas. The partitioning walls 44 bridge the left and right walls 40 and 41. The partitioning walls 44 have a flat plate shape that is generally rectangular in a front view and elongated in the left-right direction. In a left-right projection, the bottom surfaces of the partitioning walls 44 are flush with the top surface of the left support part 50 provided on the left wall 40 and the top surface of the right support part 57 provided on the right wall 41, and the top surfaces of the partitioning walls 44 are flush with the top surface of the left plate part 49 constituting the left wall 40.

Therefore, the space in the drawer frame 39 is partitioned into four spaces in the center of the drawer frame 39 defined by neighboring partitioning walls 44 that oppose each other in the front-rear direction and the left and right walls 40 and 41; a space in the front end of the drawer frame 39 defined by the front wall 42, the forwardmost partitioning wall 44, and the left and right walls 40 and 41; and a space in the rear end of the drawer frame 39 defined by the rear wall 43, the rearmost partitioning wall 44, and the left and right walls 40 and 41. These spaces will be called cartridge-accommodating sections 64. Thus, four cartridge-accommodating sections 64 juxtaposed in the front-rear direction are defined in the drawer frame 39.

(2) Process Cartridges

The process cartridges 17 are detachably accommodated in the corresponding cartridge-accommodating sections 64. Here, each process cartridge 17 is supported in the drawer frame 39 with its bottom edge contacting the top surface on the left support part 50 of the left wall 40 and the top surface on the right support part 57 of the right wall 41 within the respective cartridge-accommodating section 64. Each process cartridge 17 is also provided with a cartridge frame 67.

As shown in FIGS. 2A, 2B and 7A, the cartridge frames 67 have a box-like shape that is open on the bottom. As shown in FIGS. 2A, 2B and 7A, each cartridge frame 67 includes a cartridge-side electrode-forming part 69.

Each cartridge-side electrode-forming part 69 has a general rectangular shape and protrudes leftward from the left surface of the corresponding cartridge frame 67 at the top thereof. When the process cartridge 17 is accommodated in the corresponding cartridge-accommodating section 64, the cartridge-side electrode-forming part 69 protrudes farther leftward than the left wall 40. More specifically, the left surface of the cartridge-side electrode-forming part 69 is positioned farther leftward than the left surface of the left plate part 49 constituting the left wall 40. With this configuration, a recessed part 74 is formed in the left portion of the drawer frame 39 accommodating the process cartridge 17. The recessed part 74 spans the entire front-rear length of the same. Each of the cartridge-side electrode-forming parts 69 is also provided with three cartridge-side electrodes 70.

The cartridge-side electrodes 70 are spaced at intervals in the front-rear direction. The cartridge-side electrodes 70 are formed in a general rectangular shape and protrude leftward from the left surface of the cartridge-side electrode-forming part 69. While not shown in the drawings, the cartridge-side electrodes 70 are electrically connected to the interior of the cartridge frame 67 and function to supply power from a body-side electrode 95 (described later) provided in the main casing 2 to the photosensitive drum 18, charging roller 19, developing roller 20, and supply roller of the corresponding process cartridge 17.

A development coupling 71 and a drum coupling 72 are provided in the right wall of the cartridge frame 67, as shown in FIGS. 2 and 6.

The development coupling 71 is formed in the right wall of the corresponding cartridge frame 67 at the upper rear portion thereof. The development coupling 71 has a general disc shape. A groove that is generally rectangular in a side view is formed in the center of the development coupling 71. The development coupling 71 is connected to a gear train (not shown) for transmitting a drive force from a development drive supply unit 98 described later to the charging roller 19, developing roller 20, and supply roller 21.

The drum coupling 72 is formed in the right wall of the corresponding cartridge frame 67 in the lower front portion thereof. The drum coupling 72 has a general disc shape. A groove that is generally rectangular in a side view is formed in the center of the drum coupling 72. The drum coupling 72 is connected to the photosensitive drum 18 inside the corresponding cartridge frame 67 and is configured to transmit a drive force from a drum drive supply unit 99 (described later) to the photosensitive drum 18.

3. Main Casing

As shown in FIG. 2A, the main casing 2 includes an outer casing 80 forming the outer shape of the printer 1, and an inner casing 81 provided on the inside of the outer casing 80.

(1) Outer Casing

The outer casing 80 has a box-like shape. The access opening 6 is provided in the front end of the outer casing 80 and is exposed or closed by opening and closing the front cover 7.

(2) Inner Casing

The inner casing 81 has a generally square cylindrical shape that is elongated in the front-rear direction. The vertical and left-right dimensions of the inner casing 81 are sufficient for integrally accommodating the sheet-feeding unit 3 and image-forming unit 4. The inner casing 81 further includes a pair of drawer guides 83. The drawer guides 83 are pivotably supported in the inner casing 81 through interlocking mechanism 84.

The drawer guides 83 are formed for movably retaining the drawer frame 39 so that the drawer frame 39 can slide into and out of the main casing 2. The drawer guides 83 have a general rail-like shape that is substantially L-shaped in a front view. The drawer guides 83 extend in the front-rear direction. The top sides of the drawer guides 83 are open within the outer left and right edges of the same. The top surfaces of the drawer guides 83 formed in the inner recessed portions are defined as guide surfaces 86. The guide surfaces 86 guide the sliding movement of the drawer frame 39. Stoppers (not shown) are also provided on the drawer guides 83 for restricting movement of the drawer frame 39 relative to the drawer guides 83 when the drawer frame 39 has been moved from the external position to the intermediate position.

The interlocking mechanisms 84 are configured to move the drawer frame 39 between the intermediate position shown in FIGS. 4A and 4B and the mounted position shown in FIGS. 2A and 2B via the drawer guides 83. More specifically, the interlocking mechanisms 84 translationally move the drawer guides 83 in which the drawer frame 39 is supported diagonally upward and forward as the front cover 7 is opened, as illustrated in FIGS. 4A and 4B, and translationally move the drawer guides 83 diagonally downward and rearward when the front cover 7 is closed, as illustrated in FIGS. 2A and 2B. Each interlocking mechanism 84 includes a pair of rotating parts 88, and a pair of following parts 89.

The rotating parts 88 are disposed on the front portion of the inner casing 81. The rotating parts 88 have a flat plate shape that is generally rectangular in a side view and elongated in the front-rear direction. The front edges of the rotating parts 88 are formed continuously with the bottom end of the front cover 7 on respective left and right outer portions thereof. Each rotating part 88 includes a body-side boss 91, and a guide-side boss 92.

The body-side bosses 91 have a general columnar shape and protrude outward in left and right directions from respective left and right outer surfaces on the front portions of the rotating parts 88. The body-side bosses 91 are rotatably mounted on both side walls of the inner casing 81 at the lower front portions thereof. Thus, the front cover 7 can pivot about the body-side bosses 91.

The guide-side bosses 92 have a general columnar shape and protrude outward in left and right directions from respective left and right inner surfaces on the rear portions of the rotating parts 88. The guide-side bosses 92 are rotatably mounted on the front ends of the drawer guides 83 from the outer left and right sides thereof. Thus, the guide-side bosses 92 can pivot the drawer guides 83 about the body-side bosses 91.

The following parts 89 are disposed on the rear portion of the inner casing 81. The structure of the following parts 89 is similar to that of the rotating parts 88, except that the following parts 89 are not connected to the front cover 7. The body-side bosses 91 of the following parts 89 are rotatably mounted in both side walls of the inner casing 81 in the lower rear portions thereof. The guide-side bosses 92 of the following parts 89 are rotatably mounted in the rear ends of the drawer guides 83 from the outer left and right sides thereof.

With this construction, the interlocking mechanisms 84 support the drawer guides 83 so as to be capable of pivoting the drawer guides 83 relative to the inner casing 81 in association with the opening and closing of the front cover 7.

The inner casing 81 is further provided with four each of body-side electrodes 95, development drive supply units 98, and drum drive supply units 99.

The body-side electrodes 95 function to supply power to the corresponding process cartridges 17. The body-side electrodes 95 have a general plate shape and are arranged at intervals in the front-rear direction and penetrate the left wall of the inner casing 81. Elastic springs (not shown) constantly urge the body-side electrodes 95 rightward. Each of the body-side electrodes 95 has three metal terminals 96.

The metal terminals 96 are arranged at positions spaced in the front-rear direction that correspond to the cartridge-side electrodes 70 on the cartridge frames 67. The metal terminals 96 have a general conical shape and protrude from the right surface of the body-side electrodes 95.

The development drive supply units 98 function to supply a drive force to the corresponding process cartridges 17 via the corresponding development couplings 71. The development drive supply units 98 are disposed at intervals in the front-rear direction and penetrate the right wall of the inner casing 81. The development drive units 98 have a general columnar shape in the center of which is provided a protrusion that has a substantially rectangular shape in a side view. The protrusion on each development drive supply unit 98 has outer dimensions that can be fitted into the corresponding development coupling 71. The development drive supply units 98 are configured to advance and retract in association with the opening and closing of the front cover 7. Specifically, the development drive supply units 98 advance leftward when the front cover 7 is moved toward the closed position and are retracted into the right wall of the inner casing 81 when the front cover 7 begins to pivot toward the open position.

The drum drive supply units 99 function to supply a drive force to the corresponding process cartridges 18 via the drum couplings 72. The guide-side bosses 92 are disposed at intervals in the front-rear direction and penetrate the right wall of the inner casing 81. The drum drive supply units 99 have a general columnar shape with a protrusion provided in the center thereof that is generally rectangular in a side view. The protrusion on each drum drive supply unit 99 has outer dimensions that can be fitted into the corresponding drum coupling 72. As with the development drive supply units 98, the drum drive supply units 99 are configured to advance and retract in association with the opening and closing of the front cover 7.

4. Operations for Mounting and Detaching the Drawer Frame (1) Operation for Withdrawing the Drawer Frame When the user moves the front cover 7 from the closed position to the open position, the drawer frame 39 moves from the mounted position to the intermediate position. Next, as the user pulls the drawer frame 39 out of the main casing 2, the drawer frame 39 slides from the intermediate position to the external position.

(1-1) Mounted Position

When the drawer frame 39 is in the mounted position shown in FIGS. 2A and 2B, the body-side electrodes 95 of the main casing 2 are urged rightward so that the metal terminals 96 of the body-side electrodes 95 contact cartridge-side electrodes 70 on the process cartridges 17 at corresponding positions in the left-right direction. In addition, the development drive supply units 98 are fitted in the corresponding development couplings 71, and the drum drive supply units 99 are fitted in the corresponding drum couplings 72.

(1-2) Intermediate Position

Figure 3A:
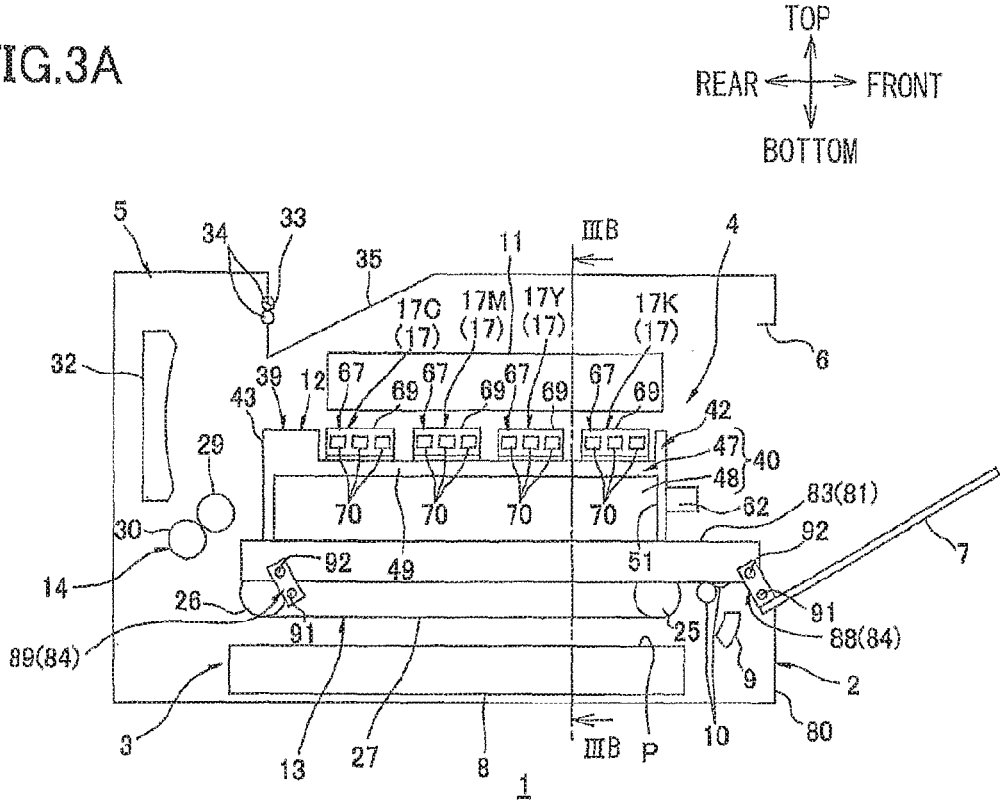
FIG. 3A is a view explaining how the drawer frame is detached from the main casing of the printer according to the first embodiment, wherein a front cover is being opened.
Figure 3B:
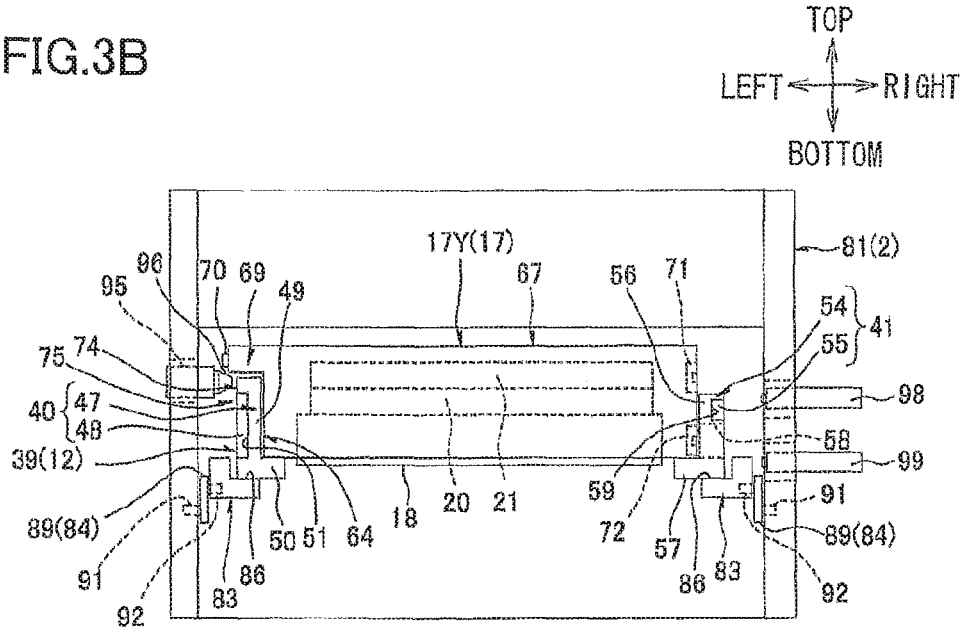
FIG. 3B is a cross-sectional view of the printer according to the first embodiment taken along a plane IIIB-IIIB shown in FIG. 3A.

When the front cover 7 is opened while the drawer frame 39 is in the mounted position as shown in FIGS. 3A and 3B, the development drive supply units 98 and drum drive supply units 99 are retracted into the right wall of the inner casing 81 in association with this opening operation.

In response to the opening of the front cover 7, the drawer guide 83 supporting the drawer frame 39 rotate clockwise in a left side view about the body-side bosses 91 of the interlocking mechanism 84.

As a result, the drawer frame 39 moves to a higher position relative to the main casing 2 than when the drawer frame 39 is in the mounted position.

Consequently, the cartridge-side electrodes 70 of the cartridge frames 67 move upward while sliding over and separate from the metal terminals 96 of the body-side electrodes 95.

When the front cover 7 is moved into the open position shown in FIG. 4A, the drawer guides 83 rotate further clockwise in a left side view about the body-side bosses 91 of the interlocking mechanisms 84. Consequently, the drawer frame 39 moves farther upward relative to the main casing 2 into the intermediate position.

As a result, the cartridge-side electrodes 70 of the cartridge frames 67 separate from the body-side electrodes 95 of the main casing 2, allowing the elastic springs (not shown) to move the body-side electrodes 95 rightward. When moving forward, the body-side electrodes 95 become disposed in spaces defined by the recessed parts 74 in the drawer frame 39 in which the respective process cartridges 17 are accommodated (hereinafter referred to as space 75).

(1-3) External Position

Next, while the drawer frame 39 is in the intermediate position, the user grips the grip part 62 of the drawer frame 39 and pulls the drawer frame 39 forward through the access opening 6 as the drawer frame 39 is guided along the guide surfaces 86 of the drawer guides 83. As a result of this operation, the drawer frame 39 arrives at the external position shown in FIGS. 5 and 6.

Next, the user mounts the process cartridges in the drawer frame 39 or detaches the process cartridges 17 from the drawer frame 39 while the drawer frame 39 is in the external position. To detach a process cartridge 17 from the drawer frame 39, the user simply pulls up on the process cartridge 17. To mount a process cartridge 17 in the drawer frame 39, the user places the process cartridge 17 in a prescribed position above the drawer frame 39 and inserts the process cartridge 17 down into the drawer frame 39.

(2) Operations for Pushing the Drawer Frame into the Main Casing

When the user pushed the drawer frame 39 into the main casing 2, the drawer frame 39 moves from the external position to the intermediate position constituting one of the internal positions. Next, the drawer frame 39 moves from the intermediate position into the mounted position in association with an operation to close the front cover 7.

When mounting the drawer frame 39 in the main casing 2, the operations for withdrawing the drawer frame 39 described above are performed in reverse.

First, the drawer frame 39 is placed on the guide surfaces 86 of the drawer guides 83 and is subsequently moved rearward along the guide surfaces 86. Through this operations, the drawer frame 39 is pushed into the intermediate position inside the main casing 2, as illustrated in FIGS. 4A and 4B.

In the intermediate position, stoppers (not shown) provided on the drawer guides 83 prevent the drawer frame 39 from moving further relative to the drawer guides 83.

Next, the user closes the front cover 7.

As the front cover 7 is closed, the drawer guides 83 supporting the drawer frame 39 rotate counterclockwise in a left side view about the body-side bosses 91 of the interlocking mechanisms 84, as shown in FIGS. 3A and 3B.

At this time, the cartridge-side electrode-forming parts 69 of the process cartridges 17 contact the body-side electrodes 95 in the main casing 2 from above.

As a result, the cartridge-side electrode-forming parts 69 push the body-side electrodes 95 leftward against the urging force of the elastic springs (not shown) as the drawer frame 39 moves downward.

When the front cover 7 arrives at the closed position shown in FIG. 2A, the metal terminals 96 of the body-side electrodes 95 are in contact with the corresponding cartridge-side electrodes 70 of the cartridge-side electrode-forming parts 69.

The development drive supply units 98 and drum drive supply units 99 also advance leftward as the front cover 7 moves into the closed position and contact the corresponding development couplings 71 and drum couplings 72 of the process cartridges 17.

Through these operations, the drawer frame 39 is disposed in the mounted position, completing the process for mounting the drawer frame 39 in the main casing 2.

Figure 5:
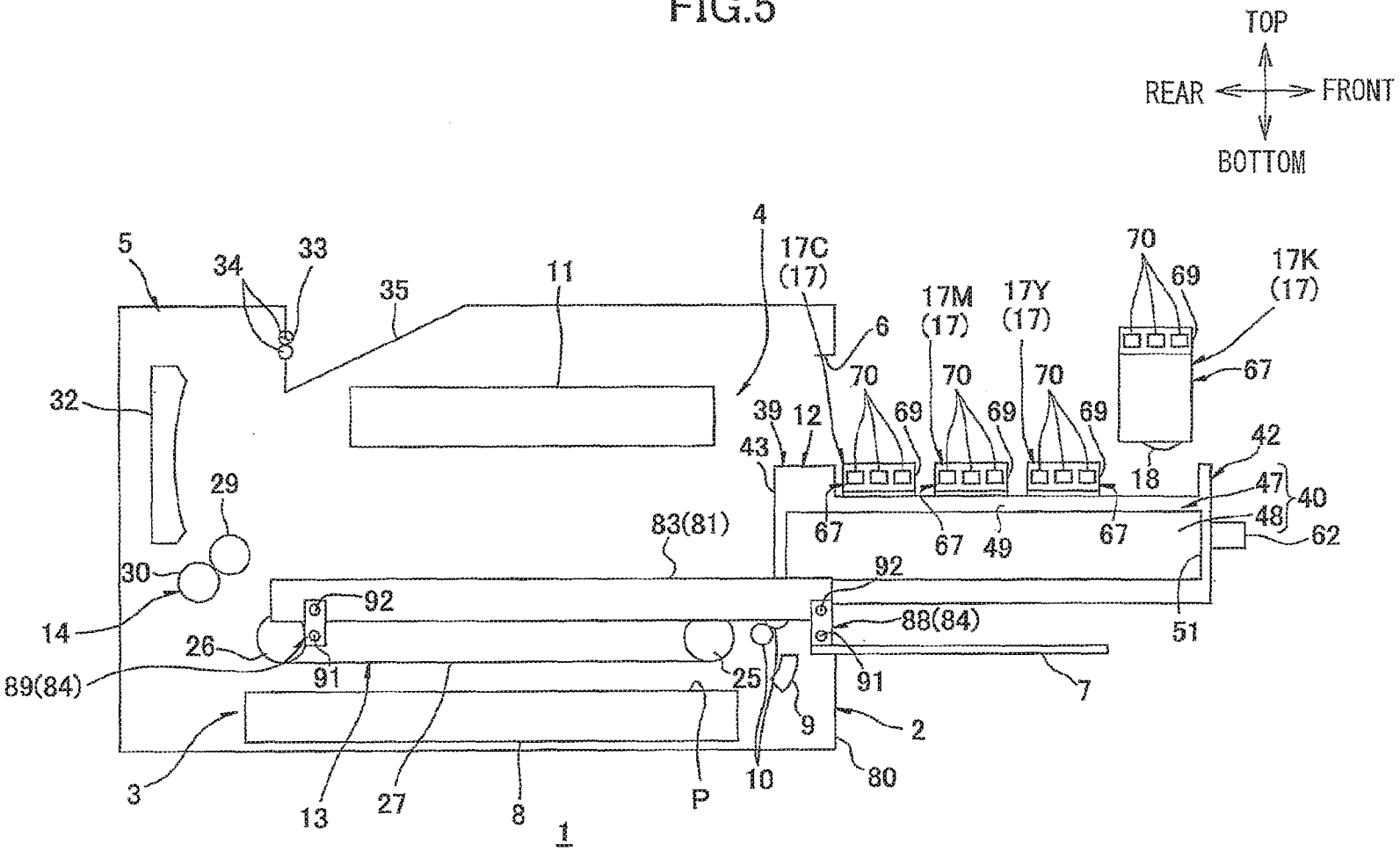
FIG. 5 is a left side view explaining how the drawer frame is detached from the main casing of the printer according to the first embodiment, wherein the drawer frame is in an external position.

5. Operational Advantages (1) In the printer 1 according to the preferred embodiment, the process cartridges 17 are accommodated in the drawer frame 39 at positions juxtaposed in the front-rear direction. As illustrated in FIG. 5, the process cartridges 17 are mounted in and detached from the drawer frame 39 when the drawer frame 39 is disposed in the external position.

The body-side electrodes 95 provided in the inner casing 81 of the main casing 2 and the cartridge-side electrodes 70 disposed on the left sides of the process cartridges 17 are positioned so as to connect respectively with each other when the process cartridges 17 are accommodated in the drawer frame 39. In order that the body-side electrodes 95 can connect to the cartridge-side electrodes 70, the top edge of the left wall 40 constituting the drawer frame 39 is kept at a low position.

With this configuration, the strength of the left wall 40 cannot be ensured when the drawer frame 39 is disposed in the external position, leaving the drawer frame 39 vulnerable to deformation or damage. However, the drawer frame 39 of the preferred embodiment is provided with a metal left reinforcing member 48 over the left wall 40, as shown in FIGS. 2A and 2B, in order to reinforce the resinous left frame 47.

Providing the left reinforcing member 48 to reinforce the left frame 47 ensures that the left wall 40 has high rigidity despite its top edge being restricted to a low position.

With this construction, the present invention provides a novel image forming apparatus.

As shown in FIG. 6, the development drive supply units 98 provided in the inner casing 81 of the main casing 2 and the development couplings 71 disposed on the right side of the process cartridges 17 are positioned to connect respectively with one another when the process cartridges 17 are accommodated in the drawer frame 39. In order to connect the development drive supply units 98 to the development couplings 71, it is necessary to restrict the top edge of the right wall 41 constituting the drawer frame 39 to a low position.

Consequently, it is not possible to ensure the strength of the right wall 41 when the drawer frame 39 is pulled out to the external position, leaving the drawer frame 39 susceptible to deformation or damage. However, the drawer frame 39 in the preferred embodiment is provided with a metal right reinforcing member 55 over the right wall 41 for reinforcing the resinous right frame 54.

Providing the right reinforcing member 55 to reinforce the right frame 54 ensures that the right wall 41 has high rigidity despite its top edge being restricted to a low position.

With this construction, the present invention provides a novel image forming apparatus.

(2) With the printer 1 according to the preferred embodiment, the operator pushed the drawer frame 39 rearward when the drawer frame 39 is in the external position shown in FIG. 5 in order to place the drawer frame 39 in the intermediate position shown in FIGS. 4A and 4B. From the intermediate position, the operator moves the drawer frame 39 into the mounted position shown in FIGS. 2A and 2B in order to connect the body-side electrodes 95 to the cartridge-side electrodes 70.

When the drawer frame 39 is in the intermediate position and external position shown in FIGS. 4A and 5, respectively, the spaces 75 are formed between the drawer frame 39 in which the process cartridges 17 are mounted and the corresponding body-side electrodes 95. The spaces 75 ensure the separation between the cartridge-side electrodes 70 provided on the process cartridges 17 and the body-side electrodes 95.

This configuration ensures that the cartridge-side electrodes 70 and body-side electrodes 95 are not electrically connected to one another and that the printer 1 cannot be operated inadvertently when the drawer frame 39 is disposed in the intermediate position and the external position. Further, the cartridge-side electrodes 70 can be reliably placed in contact with the body-side electrodes 95 by pivoting the drawer frame 39 from the intermediate position into the mounted position shown in FIGS. 2A and 2B.

(3) The printer 1 according to the preferred embodiment has a simple structure for providing the recessed parts 74 in the drawer frame 39 that houses the process cartridges 17, as shown in FIG. 4B. The recessed parts 74 can define the spaces 75 for separating the cartridge-side electrodes 70 on the process cartridge 17 from the body-side electrodes 95.

(4) In the printer 1 of the preferred embodiment, the left support part 50 is disposed on the left wall 40 of the drawer frame 39 and the right support part 57 is disposed on the right wall 41, as shown in FIG. 2B. With this construction, the process cartridges 17 can be accommodated in the cartridge-accommodating sections 64 while the left support part 50 and right support part 57 support the bottom portions of the process cartridges 17 on both left and right sides.

6. Second Embodiment (1) Structure According to the Second Embodiment

Next, a second embodiment of the present invention will be described with reference to FIGS. 8A, 8B and 8C, wherein like parts and components are designated with the same reference numerals to avoid duplicating description.

In the first embodiment described above, the left wall 40 of the drawer frame 39 is provided with the left reinforcing member 48 having a flat plate shape that is generally rectangular in a side view, and the right wall 41 is provided with the right reinforcing member 55 having a flat plate shape that is generally rectangular in a side view, as shown in FIG. 2B.

In the second embodiment, the left wall 40 is provided with a left reinforcing member 108 having an L-shaped cross section, and the right wall 41 is provided with a right reinforcing member 115 also having an L-shaped cross section.

More specifically, the left wall 40 includes a left frame 107, and the left reinforcing member 108.

The left frame 107 is formed of a resin material, such as ABS or PS. In a left side view, the top edge of the left frame 107 is positioned lower than the top and bottom edges of the cartridge-side electrodes 70 provided on the cartridge frames 67. The left frame 107 includes a left plate part 109, and a left support part 110. A left-reinforcing-member mounting part 111 is also formed in the left frame 107.

The left plate part 109 has a flat plate shape that is generally rectangular in a side view and is elongated in the front-rear direction.

The left support part 110 is a ridge-like member that protrudes rightward from the bottom edge of the left plate part 109.

The left-reinforcing-member mounting part 111 is recessed rightward in the left surface of the left plate part 109 in an area excluding the front edge, top edge, and rear edge thereof, and is also recessed upward in the bottom surface of the left support part 110 in an area excluding the front edge, right edge, and rear edge thereof. In other words, the left-reinforcing-member mounting part 111 is formed as an L-shaped recess in the left frame 107 in a front cross-sectional view.

The left reinforcing member 108 is formed of a metal material, such as a galvanized steel sheet (SECC) or a stainless steel sheet (SUS). The left reinforcing member 108 is configured of a left erect part 112, and a left protruding part 113.

The left erect part 112 has a flat plate shape that is generally rectangular in a side view and elongated in the front-rear direction.

The left protruding part 113 has a ridge-like shape that protrudes rightward from the bottom edge of the left erect part 112.

With this configuration, the left reinforcing member 108 is formed in a plate shape having an L-shaped cross section with outer dimensions that can be received in the left-reinforcing-member mounting part 111 of the left frame 107.

The right wall 41 includes a right frame 114, and a right reinforcing member 115.

The right frame 114 is formed of a resin material, such as ABS or PS. In a right side view, the top edge of the right frame 114 is positioned lower than the bottom edges of the development couplings 71 provided on the cartridge frames 67. The right frame 114 has a front-rear dimension equivalent to the left frame 107. The right frame 114 further includes a right plate part 116, and a right support part 117. A right-reinforcing-member mounting part 119 is also formed in the right frame 114.

The right plate part 116 has a flat plate shape that is generally rectangular in a side view and elongated in the front-rear direction. The right plate part 116 includes four frame-side drive input holes 118.

The frame-side drive input holes 118 are spaced at intervals in the front-rear direction and positioned to correspond to the drum drive supply units 99 of the process cartridges 17. The frame-side drive input holes 118 are generally circular in a side view and penetrate the right plate part 116.

The right support part 117 is a ridge-like member that protrudes leftward from the bottom edge of the right plate part 116.

The right-reinforcing-member mounting part 119 is recessed leftward in the right surface of the right plate part 116 in an area excluding the front edge, top edge, and rear edge thereof and is further recesses upward in the bottom surface of the right support part 117 in an area excluding the front edge, left edge, and rear edge. In other words, the right-reinforcing-member mounting part 119 is formed as a depression in the right frame 114 that is L-shaped in a front cross-sectional view, The right reinforcing member 115 is formed of a metal material, such as a galvanized steel sheet (SECC) or a stainless steel sheet (SUS). The front-rear dimension of the right reinforcing member 115 is equivalent to that of the left reinforcing member 108. The right reinforcing member 115 is configured of a right erect part 120, and a right protruding part 121.

The right erect part 120 has a flat plate shape that is generally rectangular in a side view and elongated in the front-rear direction. The right erect part 120 also has four reinforcement-side drive input holes 122.

The reinforcement-side drive input holes 122 are spaced at intervals in the front-rear direction and are positioned to correspond to the drum drive supply units 99 of the process cartridges 17. The reinforcement-side drive input holes 122 are generally circular in a side view and penetrate the right erect part 120.

The right protruding part 121 has a ridge-like shape that protrudes leftward from the bottom edge of the right erect part 120.

With this construction, the right reinforcing member 115 is formed in a plate shape having an L-shaped cross section with outer dimensions that can be received in the right-reinforcing-member mounting part 119 of the right frame 114.

(2) Effects of the Second Embodiment

Figure 8A:
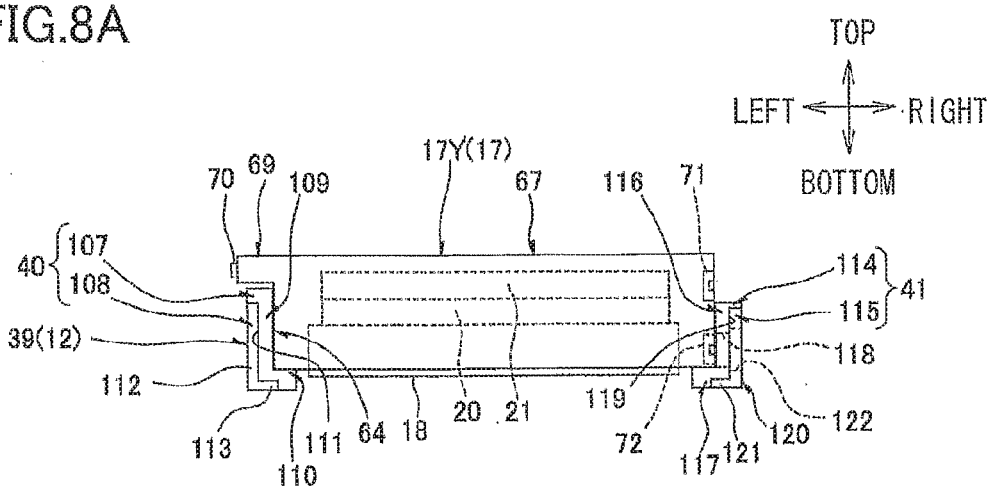
FIG. 8A is a front cross-sectional view of a drawer frame of a printer according to a second embodiment of the present invention.
Figure 8B:
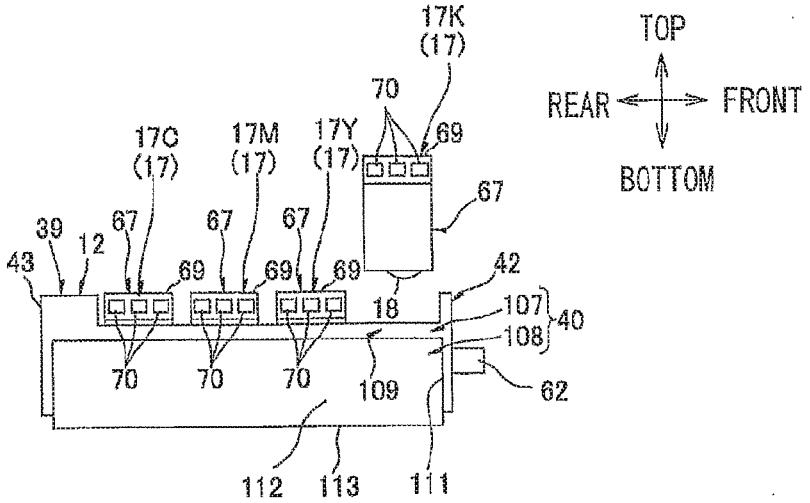
FIG. 8B is a left side view of the drawer frame of the printer according to the second embodiment of the present invention.
Figure 8C:
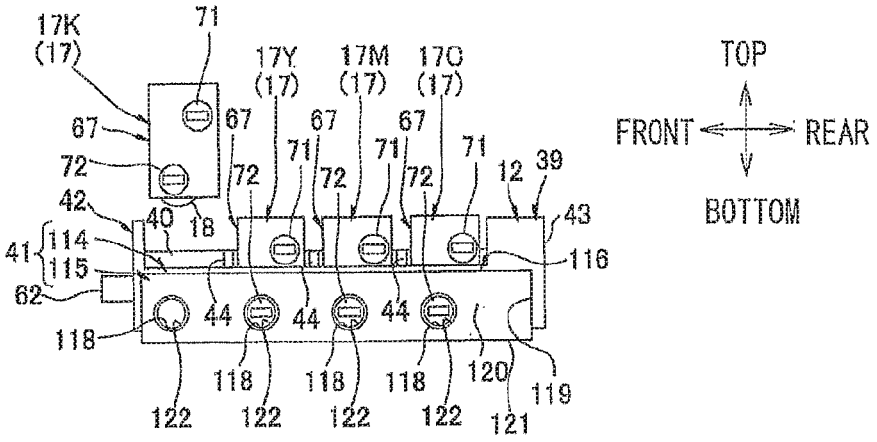
FIG. 8C is a right side view of the drawer frame of the printer according to the second embodiment of the present invention.

In the drawer frame 39 according to the second embodiment, the metal left reinforcing member 108 is provided on the left wall 40 of the drawer frame 39 to reinforce the resinous left frame 107, as illustrated in FIGS. 8A, 8B and 8C. Further, since the left reinforcing member 108 is formed with the left protruding part 113, the left reinforcing member 108 can provide high rigidity in order to reliably reinforce the left wall 40.

Thus, the structure of the second embodiment can ensure even greater rigidity of the left wall 40 than the structure of the first embodiment.

Hence, the present invention provides a novel image forming apparatus.

The drawer frame 39 according to the second embodiment also has the metal right reinforcing member 115 provided on the right wall 41 in order to reinforce the resinous right frame 114. Since the right reinforcing member 115 is also provided with the right protruding part 121, the right reinforcing member 115 can provide high rigidity in order to reliably reinforce the right wall 41.

Hence, the structure according to the second embodiment can achieve even higher rigidity of the right wall 41 than the structure of the first embodiment.

Accordingly, the present invention provides a novel image forming apparatus.

The printer 1 according to the second embodiment can achieve the same operational advantages described in the first embodiment.

7. Third Embodiment (1) Structure According to the Third Embodiment

Next, a third embodiment of the present invention will be described with reference to FIG. 9A, wherein like parts and components are designated with the same reference numerals to avoid duplicating description.

In the first embodiment described above, the process cartridges 17 are supported in the drawer frame 39 with their bottom edges contacting the top surface on the left support part 50 of the left wall 40 and the top surface on the right support part 57 of the right wall 41 within the corresponding cartridge-accommodating sections 64, as shown in FIG. 2B.

In the second embodiment, the process cartridges 17 are supported in the corresponding cartridge-accommodating sections 64 of the drawer frame 39 with their bottom edges contacting the top surface on the left support part 110 of the left wall 40 and the top surface on the right support part 117 of the right wall 41, as shown in FIG. 8A.

Figure 9A:
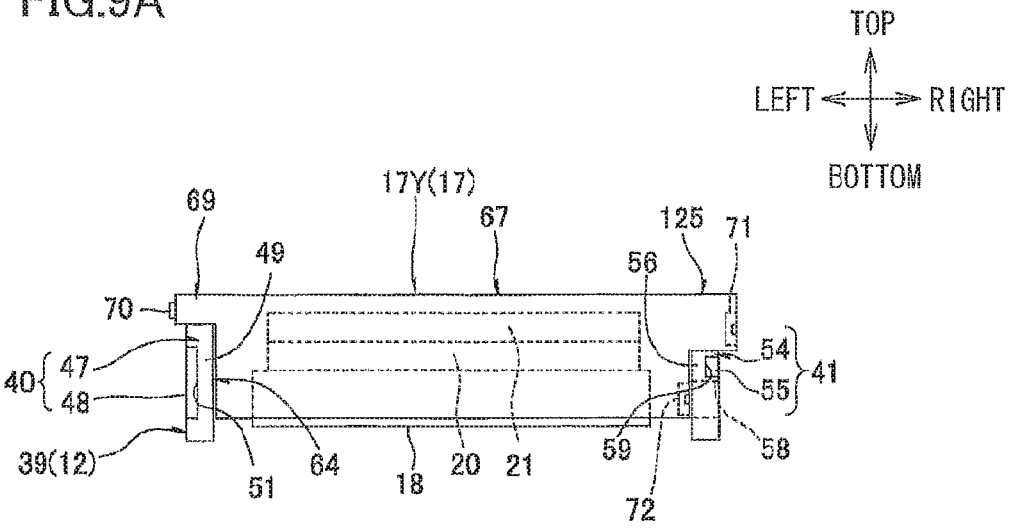
FIG. 9A is a front cross-sectional view of a drawer frame of a printer according to the third embodiment of the present invention.

However, in the third embodiment shown in FIG. 9A, the process cartridges 17 are supported in the drawer frame 39 while contacting the top surfaces of the left wall 40 and right wall 41 of the drawer frame 39.

More specifically, each process cartridge 17 is provided with a development-coupling forming part 125. The development-coupling forming part 125 has a general rectangular shape and protrudes rightward from the right surface of the cartridge frame 67 on the upper portion thereof.

The development-coupling forming part 125 protrudes farther rightward than the right wall 41 when the process cartridge 17 is accommodated in the corresponding cartridge-accommodating section 64. That is, the right surface of the development-coupling forming part 125 is positioned rightward of the right surface on the right plate part 56 of the right wall 41.

Next, each process cartridge 17 is supported in the drawer frame 39 such that the bottom surface of the cartridge-side electrode-forming part 69 contacts the top surface of the left wall 40 and the bottom surface of the development-coupling forming part 125 contacts the top surface of the right wall 41.

With this configuration, the top surfaces of the left wall 40 and right wall 41 serve as supporting parts.

(2) Effects of the Third Embodiment

According to the third embodiment described above, the process cartridges 17 can be supported using the top surfaces of the left wall 40 and right wall 41, eliminating the need for support parts provided on the lower side of the drawer frame 39 for supporting the process cartridges 17.

Accordingly, the process cartridges 17 can be supported in the drawer frame 39 through a simple construction.

The printer 1 according to the third embodiment can achieve the same operational advantages described in the first embodiment.

8. Fourth Embodiment (1) Structure According to the Fourth Embodiment

Next, a fourth embodiment of the present invention will be described with reference to FIG. 9B, wherein like parts and components are designated with the same reference numerals to avoid duplicating description.

In the first embodiment described above, the top edge of the left reinforcing member 48 is positioned lower than the top edge of the left frame 47 in a left side view, as shown in FIG. 2B. Further, the top edge of the right reinforcing member 55 is positioned lower than the top edge of the right frame 54 in a right side view, as shown in FIG. 2B.

Figure 9B:
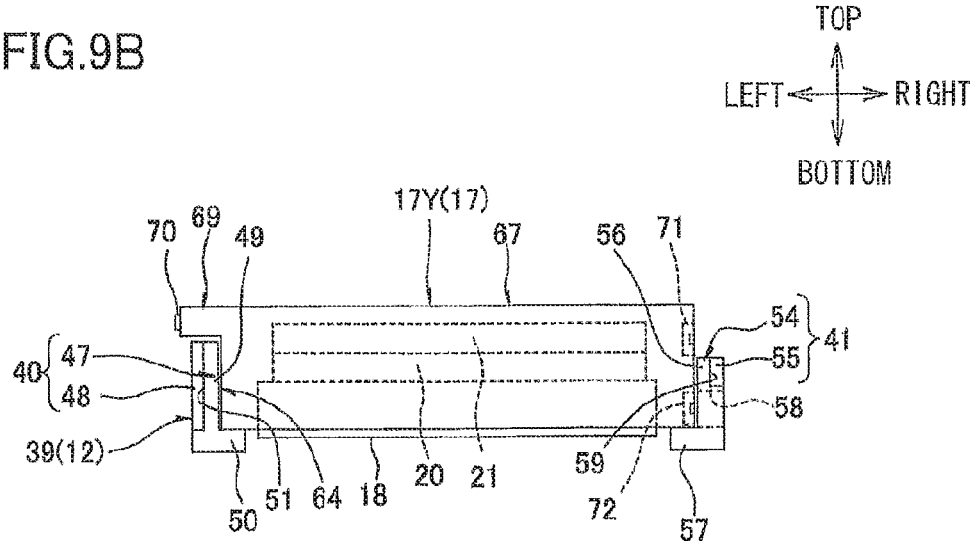
FIG. 9B is a front cross-sectional view of a drawer frame of a printer according to the fourth embodiment of the present invention.

In the fourth embodiment shown in FIG. 9B, the top edge of the left frame 47 is disposed at the same vertical position as the top edge of the left reinforcing member 48 in a left side view. Further, the top edge of the right frame 54 is at the same vertical position as the top edge of the right reinforcing member 55 in a right side view.

(2) Effects of the Fourth Embodiment

According to the fourth embodiment described above, the top edge of the left reinforcing member 48 can be extended as far as the top edge of the left frame 47, thereby increasing the proportional size of the left reinforcing member 48 relative to the left wall 40. Accordingly, the structure of the fourth embodiment can achieve a greater rigidity than that described in the first embodiment.

In addition, the top edge of the right reinforcing member 55 can be extended as far as the top edge of the right frame 54, thereby achieving greater rigidity in the right wall 41 than the structure described in the first embodiment.

The printer 1 according to the fourth embodiment can achieve the same operational advantages described in the first embodiment.

9. Variations of the Embodiments

In the first, second, and third embodiments described above, the black process cartridge 17K may serve as a claimed first cartridge while the process cartridges 17 of the remaining colors serve as claimed second cartridges, but the black process cartridge 17K may instead serve as the claimed second cartridge while the other process cartridges 17 serve as the claimed first cartridges. Alternatively, one of the process cartridges 17, such as the yellow process cartridge 17Y, may serve as the claimed second cartridge while one or more of the remaining process cartridges 17 serve as the claimed first cartridges.

In each of these cases, the photosensitive drum 18, charging roller 19, developing roller 20, and supply roller 21 in the process cartridges 17 serving as the claimed first cartridges constitute examples of a claimed first process body and a claimed third process body; the cartridge-side electrodes 70 on the process cartridges 17 serving as the claimed first cartridges constitute an example of claimed first power-receiving parts; and the development couplings 71 on process cartridges 17 serving as the claimed first cartridges constitute an example of claimed first drive-transmitting parts.

Further, the photosensitive drum 18, charging roller 19, developing roller 20, and supply roller 21 of process cartridges 17 serving as the claimed second cartridges constitute an example of a claimed second process body and a claimed fourth process body; the cartridge-side electrodes 70 on the process cartridges 17 serving as the claimed second cartridges constitute an example of claimed second power-receiving parts; and the development couplings 71 on the process cartridges 17 serving as the claimed second cartridges constitute an example of claimed second drive-transmitting parts.

In the inner casing 81 of the main casing 2, body-side electrodes 95 corresponding to process cartridges 17 serving as the claimed first cartridges constitute an example of claimed first power-supplying parts; and development drive supply units 98 corresponding to process cartridges 17 serving as the claimed first cartridges constitute an example of claimed first drive-supplying parts.

Further, body-side electrodes 95 corresponding to process cartridges 17 serving as the claimed second cartridges constitute an example of claimed second power-supplying parts; and development drive supply units 98 corresponding to process cartridges 17 serving as the claimed second cartridges constitute an example of claimed second drive-supplying parts.

While the invention has been described in detail with reference to the embodiments thereof, it would be apparent to those skilled in the art that various changes and modifications may be made therein without departing from the spirit of the invention.

What is claimed is:

1. An image forming apparatus comprising:

a main body including a first electrode and having an inner surface and a receiving area, the first electrode being disposed on the inner surface of the main body;

a cartridge having a process body and a second electrode electrically connected to the process body; and a drawer frame movably engaged with the main body, the drawer frame including a first wall, a second wall, and a third wall, the first wall and the third wall extending in a first direction in which the drawer frame is movable into and from the receiving area of the main body, the second wall extending in a second direction perpendicular to the first direction and being disposed between the first wall and the third wall, the first wall including a first frame formed of a first material having a first rigidity and a second frame formed of a second material having a second rigidity different from the first rigidity, the first material being different from the second material, the first wall, the second wall, and the third wall defining a cartridge mounting area, the first frame having a upward cutout, wherein, when the cartridge is placed in the cartridge mounting area of the drawer frame, the second electrode is disposed along the first frame of the drawer frame, thereby allowing the first electrode to contact with the second electrode through the upward cutout.

2. The image forming apparatus according to claim 1, wherein the second frame is at least partially disposed between the first frame and the main body in the second direction.

3. The image forming apparatus according to claim 2, wherein a top edge of the second frame is lower than a lowest point of the upward cutout of the first frame.

4. The image forming apparatus according to claim 1, wherein the second rigidity is greater than the first rigidity.

5. The image forming apparatus according to claim 1, wherein the first frame is formed of a resin material.

6. The image forming apparatus according to claim 1, wherein the second frame is formed of a metal material.

7. The image forming apparatus according to claim 1, wherein, when the drawer frame is in a mounted position within the receiving area of the main body, the drawer frame is disposed lower within the receiving area in a third direction perpendicular to both the first direction and the second direction than when the drawer frame is not in the mounted position.

8. An image forming apparatus comprising:

a main body including a first drive supply part and a second drive supply part and having an inner surface and a receiving area, both the first drive supply part and the second drive supply part being disposed on the inner surface of the main body;

a cartridge including a first process body, a second process body, a first coupling, and a second coupling, the first drive supply part supplying a drive force to the first process body via the first coupling, the second drive supply part supplying a drive force to the second process body via the second coupling; and a drawer frame movably engaged with the main body, the drawer frame including a first wall, a second wall, and a third wall, the first wall and the third wall extending in a first direction in which the drawer frame is movable into and from the receiving area of the main body, the second wall extending in a second direction perpendicular to the first direction and being disposed between the first wall and the third wall, the first wall, the second wall, and the third wall defining a cartridge mounting area, the third wall having a upward cutout and a through hole, wherein, when the cartridge is placed in the cartridge mounting area of the drawer frame, the first coupling and the second coupling are disposed along the third wall of the drawer frame, thereby allowing the first coupling to connect with the first drive supply part through the upward cutout and thereby allowing the second coupling to connect with the second drive supply part through the through hole, and wherein the third wall includes a first frame formed of a first material having a first rigidity and a second frame formed of a second material having a second rigidity different from the first rigidity, the first material being different from the second material.

9. The image forming apparatus according to claim 8, wherein a position of the upward cutout is higher than a position of the through hole.

10. The image forming apparatus according to claim 8, wherein the drawer frame further includes a fourth wall extending in the second direction, the fourth wall extending between the first wall and the third wall, the first frame and the second frame extending from at least the second wall to at least the fourth wall in the first direction.

11. The image forming apparatus according to claim 8, wherein the second rigidity is greater than the first rigidity.

12. The image forming apparatus according to claim 8, wherein the second frame is at least partially disposed between the first frame and the main body in the second direction, and wherein the first frame includes the upward cutout.

13. The image forming apparatus according to claim 8, wherein the through hole has a circular shape.

14. The image forming apparatus according to claim 8, wherein the first process body is a developing roller, and the first coupling is a development coupling connected with the developing roller.

15. The image forming apparatus according to claim 8, wherein the second process body is a photosensitive drum, and the second coupling is a photosensitive coupling connected with the photosensitive drum.

16. An image forming apparatus comprising:

a main body including a first electrode, a first drive supply part, and a second drive supply part and having a first inner surface, a second inner surface, and a receiving area, the first inner surface being opposite to the second inner surface relative to the receiving area, the first electrode being disposed on the first inner surface, both the first drive supply part and the second drive supply part being disposed on the second inner surface of the main body;

a cartridge having a second electrode, a first coupling, and a second coupling; and a drawer frame movably engaged with the main body, the drawer frame including a first wall, a second wall, and a third wall, the first wall and the third wall extending in a first direction in which the drawer frame is movable into and from the receiving area of the main body, the second wall extending in a second direction perpendicular to the first direction and being disposed between the first wall and the third wall, the first wall, the second wall, and the third wall defining a cartridge mounting area, the first wall having a first upward cutout, the third wall having a second upward cutout and a through hole, wherein the first wall includes a first frame formed of a first material having a first rigidity and a second frame formed of a second material having a second rigidity different from the first rigidity, the first material being different from the second material, and wherein, when the cartridge is placed in the cartridge mounting area of the drawer frame:

the second electrode is disposed along the first wall of the drawer frame, thereby allowing the first electrode to contact the second electrode through the first upward cutout, the first coupling and the second coupling are disposed along the third wall of the drawer frame, thereby allowing the first coupling to connect with the first drive supply part through the second upward cutout and allowing the second coupling to connect with the second drive supply part through the through hole.

17. The image forming apparatus according to claim 16, wherein a cartridge has a process body, the second electrode being electrically connected to the process body.

18. The image forming apparatus according to claim 16, wherein the cartridge includes a first process body and a second process body, the first drive supply part supplying a drive force to the first process body via the first coupling, the second drive supply part supplying a drive force to the second process body via the second coupling.

* * * * *